US010321799B2

(12) United States Patent
Dhillon

(10) Patent No.: US 10,321,799 B2
(45) Date of Patent: Jun. 18, 2019

(54) HANDHELD BRUSH

(71) Applicant: Rashpal Dhillon, Battersea (GB)

(72) Inventor: Rashpal Dhillon, Battersea (GB)

( * ) Notice: Subject to any disclaimer, the term of this patent is extended or adjusted under 35 U.S.C. 154(b) by 295 days.

(21) Appl. No.: 15/307,609

(22) PCT Filed: Apr. 1, 2015

(86) PCT No.: PCT/GB2015/051029
§ 371 (c)(1),
(2) Date: Oct. 28, 2016

(87) PCT Pub. No.: WO2015/166206
PCT Pub. Date: Nov. 5, 2015

(65) Prior Publication Data

US 2017/0049297 A1 Feb. 23, 2017

(30) Foreign Application Priority Data

Apr. 28, 2014 (GB) ..... 1407422.3
Nov. 7, 2014 (GB) ..... 1419841.0

(51) Int. Cl.

| | |
|---|---|
| ***A47L 23/04*** | (2006.01) |
| ***A46B 11/00*** | (2006.01) |
| ***A46B 15/00*** | (2006.01) |
| ***A46B 5/02*** | (2006.01) |
| ***A46B 9/02*** | (2006.01) |

(52) U.S. Cl.
CPC ..... *A47L 23/04* (2013.01); *A46B 5/026* (2013.01); *A46B 9/025* (2013.01); *A46B 11/0041* (2013.01); *A46B 11/0079* (2013.01); *A46B 15/0081* (2013.01); *A46B 2200/306* (2013.01)

(58) Field of Classification Search
CPC ..... A47L 23/04; A47L 23/05; A47L 23/08; A46B 2200/306; A46B 11/0041; A46B 11/0079; A46B 15/0081; A46B 5/026; A46B 9/025; A46B 11/0062; A46B 5/02;
(Continued)

(56) References Cited

U.S. PATENT DOCUMENTS 212,279 A * 2/1879 Stahle ..... 401/37
1,134,037 A * 3/1915 Daniels ..... B43K 23/124 401/140
(Continued)

FOREIGN PATENT DOCUMENTS

EP 0128441 A2 5/1984
GB 775900 A 5/1957

*Primary Examiner* — David J Walczak
(74) *Attorney, Agent, or Firm* — Galgano IP Law PLLC; Thomas M. Galgano

(57) ABSTRACT

A single handheld brush includes an elongated body, first and second ends and an interior. The interior embodies a cavity, wherein, in use, fluid may be stored. The first end includes a brush head mounted on a brush base portion having a first face and a second face and a passage that runs through the brush base portion and is open at both ends, and the second end includes a scraping tool. The brush also has a flow path running from the cavity, to an aperture in the brush base portion, such that fluid in the cavity may flow along the flow path and be expelled from the aperture, and a valve closure located adjacent the first end. The valve may be moved from an open position wherein the flow path is open, to a closed position wherein the flow path is shut and vice versa.

18 Claims, 12 Drawing Sheets

(58) Field of Classification Search
CPC . A46B 5/021; A46B 15/0055; A46B 15/0065; A46B 11/0086
See application file for complete search history.

(56) References Cited

U.S. PATENT DOCUMENTS

| | | | | |
|---|---|---|---|---|
| 1,340,775 | A | 5/1920 | Kelly | |
| 2,742,658 | A | 4/1956 | Sproston | |
| 5,290,258 | A * | 3/1994 | Ennis, III | A61M 31/00 222/548 |
| 5,351,350 | A | 10/1994 | Johnson | |
| 5,857,234 | A | 1/1999 | Hernnandez | |
| 6,481,041 | B1 | 11/2002 | Ingram | |
| 9,326,655 | B2 * | 5/2016 | Call | A47L 13/12 |
| 2006/0285913 | A1 | 12/2006 | Koptis | |
| 2007/0077113 | A1 * | 4/2007 | Nanda | A46B 15/0055 401/39 |
| 2007/0077133 | A1 | 4/2007 | Puneet | |
| 2008/0178404 | A1 | 7/2008 | Wales | |
| 2009/0056748 | A1 | 3/2009 | Wales | |
| 2010/0067972 | A1 | 3/2010 | Ashworth | |

* cited by examiner

HANDHELD BRUSH

FIELD OF THE INVENTION

The invention relates generally to single hand held brushes (i.e. brushes which are held in a single hand) and in particular to improvements to hand held brushes for the cleaning of footwear.

BACKGROUND TO THE INVENTION

The closest prior art known to the applicant are brushes for cleaning shoes which have a standard brush configuration with a gripping portion, a bristle holding portion and a cluster of bristles. When cleaning fluid is required with the use of these brushes the fluid must be applied to an item of footwear, or to the brush bristles, prior to use of the brush. Often, the fluid must also be reapplied to the shoe or brush during use for effective cleaning which increases the time it takes to clean the shoe. This can also lead to an inadequate or excessive amount of fluid being applied which affects the economy of the operation.

A further disadvantage of the prior art is that several pieces of equipment must be carried where a brush and fluid are required. The number of required components is further increased where a scraper is required for removing excess dirt from a shoe prior to cleaning with a brush. This is particularly disadvantageous where a brush, fluid and scraper are required whilst on an outing such as a parent taking their child to a park. There are often a large number of items a parent must carry when on an outing with their child, and the requirement for several more in order to clean shoes is not a welcome one. Moreover, a device which offers an intuitive means of cleaning footwear would be especially advantageous, particularly where a child can use the brush without the risk of spilling cleaning fluid.

In sporting environments, where the performance of the sports boot—for example a football boot—is contingent on its cleanness and its being free from mud—in order, for example, that the studs be exposed along their full length, rather than caked in mud—there is a problem in that the provision of a compact and comprehensive personal cleaning system is not readily available. There is a need for a tool to be provided which is to hand for ex tempore cleaning.

It is amongst the objects of the invention to attempt a solution to least the above problems.

SUMMARY OF THE INVENTION

In its broadest independent aspect, the invention provides a single handheld brush, the brush comprising a body, the body being elongate and comprising first and second ends and an interior, the interior comprising a cavity, wherein, in use, fluid may be stored;

the first end comprising a brush head, and wherein the brush head is mounted on a brush base portion, the brush base portion having a first face and a second face and a passage, the passage running through the brush base portion and being open at both ends;

the second end comprising a scraping tool;

the brush further comprising a flow path running from the cavity, to an aperture in the brush base portion, such that fluid in the cavity may flow along the flow path and be expelled from the aperture, and a valve closure located adjacent the first end, wherein the valve may be moved from an open position wherein the flow path is open, to a closed position wherein the flow path is shut and vice versa, such that the flow of fluid through the aperture may be regulated.

This configuration is particularly advantageous because it provides a handheld brush, suitable for cleaning an item of footwear, which is able to disperse cleaning fluid from the brush to more effectively clean an item. The flow path between the cavity and the aperture of the brush base portion of the brush allows fluid to be expelled from the aperture and coat an item. The scraper located at the second end of the brush facilitates the removal of excess dirt from the item, and the valve closure located adjacent the first end further controls the flow of fluid through the aperture in use. Each of the components are located on a single apparatus to minimise the number of items required to effectively clean an item of footwear in this way.

Preferably, the body comprises at least a portion of resiliently deformable material and wherein, in use, squeezing the portion of resiliently deformable material causes the cavity to deform, thereby forcing fluid contained within the cavity along the flow path, such that it may be expelled from the aperture. This configuration is particularly advantageous because it allows controlled expulsion of the contained fluid from the body of the brush. A suitable amount of fluid can therefore be released in order for the brush to be used effectively.

Preferably, the valve comprises a dispensing closure, such that the valve is caused to open when the resiliently deformable portion is squeezed and fluid is forced through it, and closes when the squeezing force ceases. This configuration is particularly advantageous because it prevents unwanted release of the fluid contained in the body and therefore increases the efficiency of the brush and prevents spillages. It also removes the requirement of a manually operated valve.

Preferably, the brush comprises a bristle holding surface and wherein the aperture is located on the bristle holding surface of the brush. This configuration is particularly advantageous because it allows the fluid to flow towards the bristles of the brush to be coated with the fluid so that the brush distributes the fluid effectively over a surface.

Preferably, the first end and the second end are substantially at opposite ends of the brush. This configuration is particularly advantageous because it allows a user to intuitively hold the brush between the first end and the second end. It also minimises the possibility of the contained fluid from exiting the second end when the brush is in use.

Preferably, the resiliently deformable portion comprises a mid-section of the brush, situated between the first and second ends. This configuration is particularly advantageous because it allows a user to intuitively hold and squeeze the resiliently deformable portion to force the fluid from the aperture. The intuitive handling also allows the user to effectively control the force applied to the resiliently deformable portion.

Preferably, the brush further comprises a secondary aperture located adjacent the second end, and wherein the second end is removable and comprises a closure, in use, for the secondary aperture. This configuration is particularly advantageous because it allows the brush to be filled with fluid for expelling from the aperture. The position of the secondary aperture also minimises the possibility of fluid from exiting the secondary aperture when the resiliently deformable portion is squeezed in use, as the second end faces upwards. The secondary aperture also provides a means for evacuating fluid from the body in a straightforward manner if emptying of the brush is required.

Preferably, the scraping tool comprises at least one projecting member which projects from a surface of said second end. The at least one projecting member allows a user to effectively scrape excess mud or similar from an item of footwear whilst minimising risk of damage to the brush or to the item of footwear.

Preferably, the scraper comprises a pair of lugs, coaxially arranged around and attached to the second end. This configuration is particularly advantageous because it provides a means for a user to scrape excess dirt from an item of footwear.

Preferably, the at least one projecting lug is arranged such that it projects in a direction substantially perpendicular to the lengthwise extension of the brush. This configuration is particularly advantageous because it allows a user to intuitively switch between using the scraping tool of the brush, to remove excess mud or similar, to using the brush head end to thoroughly clean the item of footwear. It also minimises the risk of mud transferring from a previously used end of brush to another item of clothing or to the skin of the user whilst the brush is still in use.

Preferably, each of the ends and the valve is detachable from the other components of the brush. This configuration is particularly advantageous because it allows for different sized components, such as different size or strength bristles, to be removably attached to the body of the brush. It also provides a means for replacement of components, such as the scraper, when they become worn. This configuration also allows for effective cleaning of the brush components.

Preferably, the mid portion of the brush is tapered towards the second end. This configuration is particularly advantageous because it provides a suitably shaped portion for a user to hold the brush. The tapered configuration allows a user with small hands i.e. a child to hold the brush comfortably at the tapered end whilst allowing an adult to hold the brush just as comfortably at the wider diameter end.

Preferably, the mid portion comprises a curved tube. This configuration is particularly advantageous because it maximises the efficiency with which fluid is expelled from the aperture when the resiliently deformable portion is squeezed.

Preferably, the curved mid portion comprises a concavity and a grip portion, with said grip portion located within the concavity of the curve of the mid portion. This configuration is particularly advantageous because it provides an ergonomic arrangement for intuitive handling by a user. It also reduces the possibility of the user losing grip on the brush when the brush gets wet.

Preferably, said grip portion of the curved mid portion incorporates a number of depressions or embossments. The depressions or embossments provide increased grip to a user which is particularly advantages when the brush becomes wet or if a user is using the brush whilst wearing gloves.

Preferably, said brush further comprises releasable locking means for locking the valve in at least one of the open and the closed position. The locking means allows the brush head to be locked into its open and closed configurations, thereby preventing fluid from exiting the cavity of the brush when the brush is not in use, whilst allowing fluid to effectively exit the brush when in operation.

Preferably, the brush valve is adjusted from an open position to a closed position and vice versa upon the rotation of the brush head relative to the brush base portion. This configuration is particularly advantageous because it provides a mechanism which effectively contains the contained fluid when the brush is not in use. It also provides additional length to the brush when in use so that the user can achieve further reach.

Preferably, the releasable locking means comprises a detent and corresponding groove at each extremity of the relatively rotational movement, such that the detent can be clinched in and out of its groove by the rotation of the brush head and the brush base portion. This configuration is particularly advantageous because it reduces the possibility of the brush head unduly retracting whilst the brush is in use, whilst minimising the risk of the brush becoming open without the conscious rotation of the brush head and brush base portion.

Preferably, said brush further comprises a plug which contacts said valve when said brush head is in its first position. The plug prevents fluid contained within the cavity from exiting the mid-portion unless the brush head has been extended into its second, open position.

Preferably, said brush head incorporates a number of indentations or projections. The indentations or projections increase provide grip to the brush head so that it may be used especially when the brush is wet or if the user is wearing gloves. Extension of the brush head from the brush base portion is also improved as grip is improved.

BRIEF DESCRIPTION OF THE INVENTION

Figure 9B:
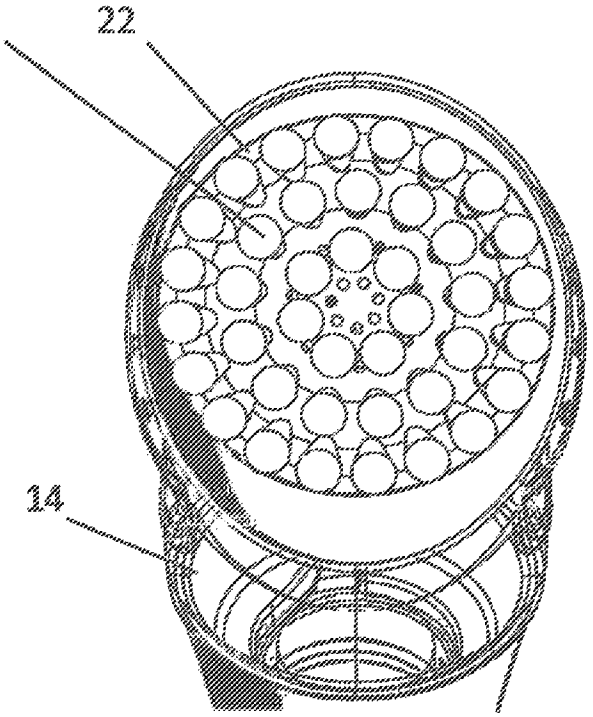
Figure 9A:
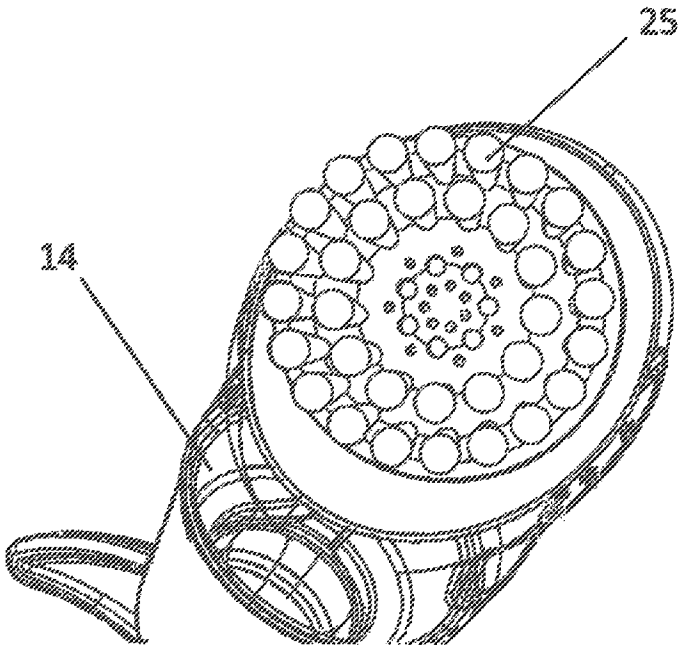

FIGS. 9*a* and 9*b* show the bristle arrangements for the brush.

Figure 10:
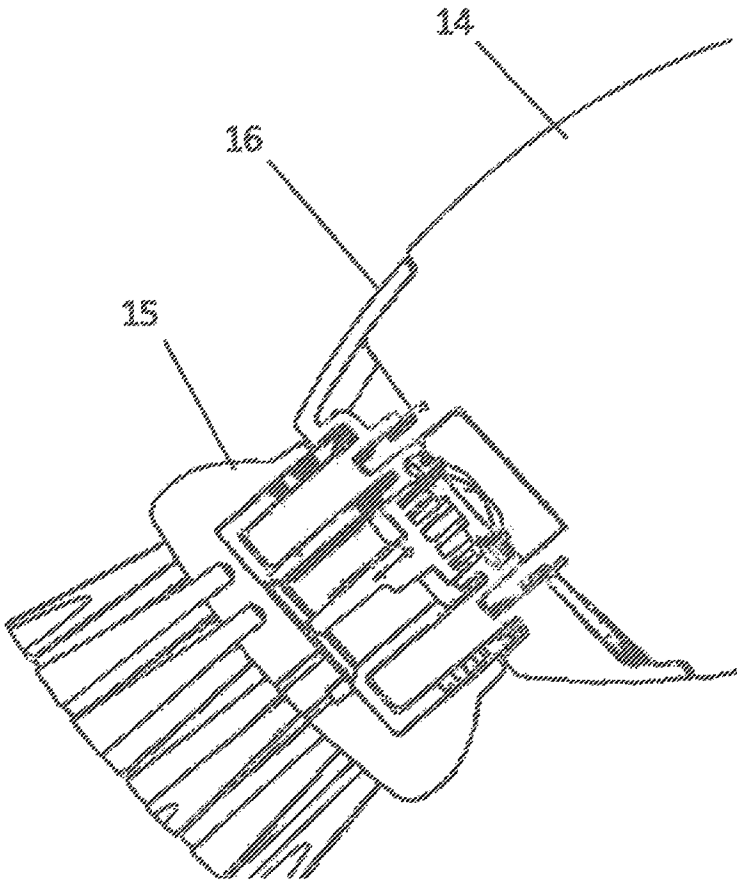
Figure 11:
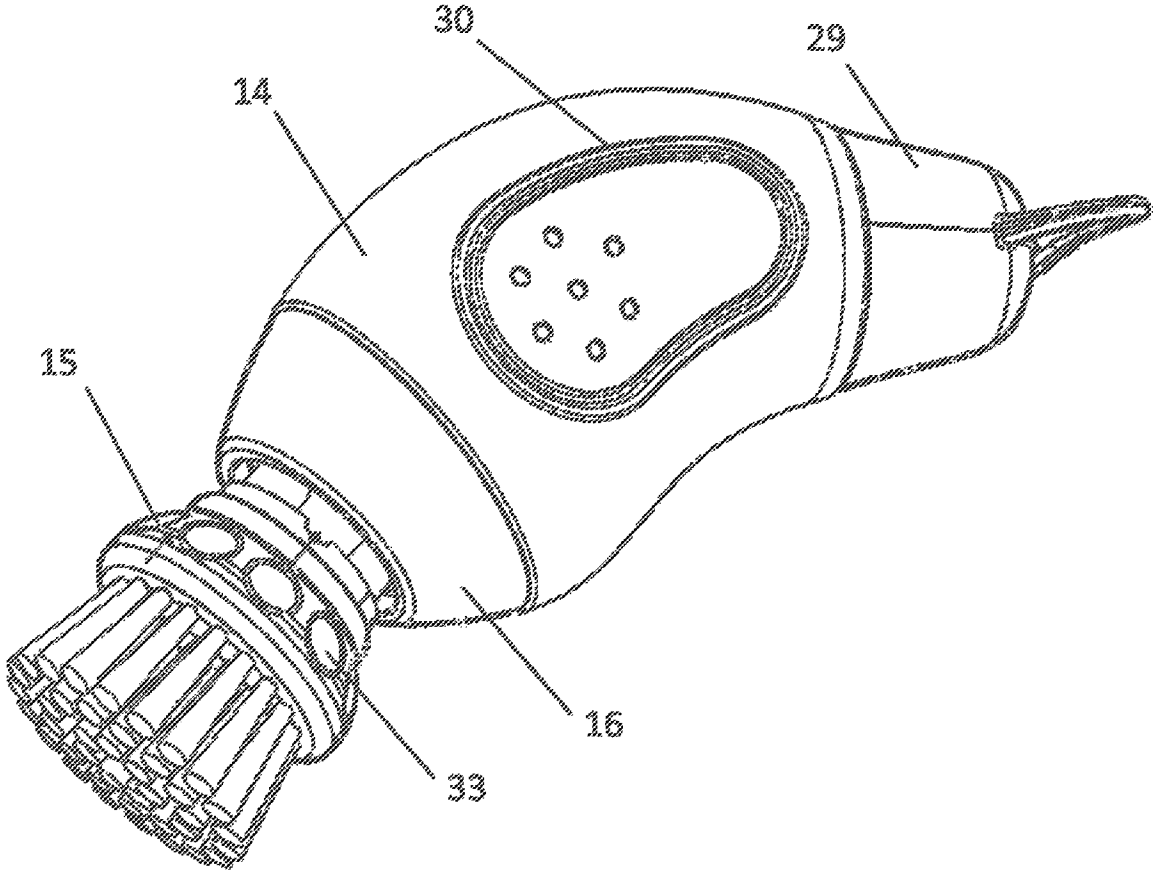
Figure 12:
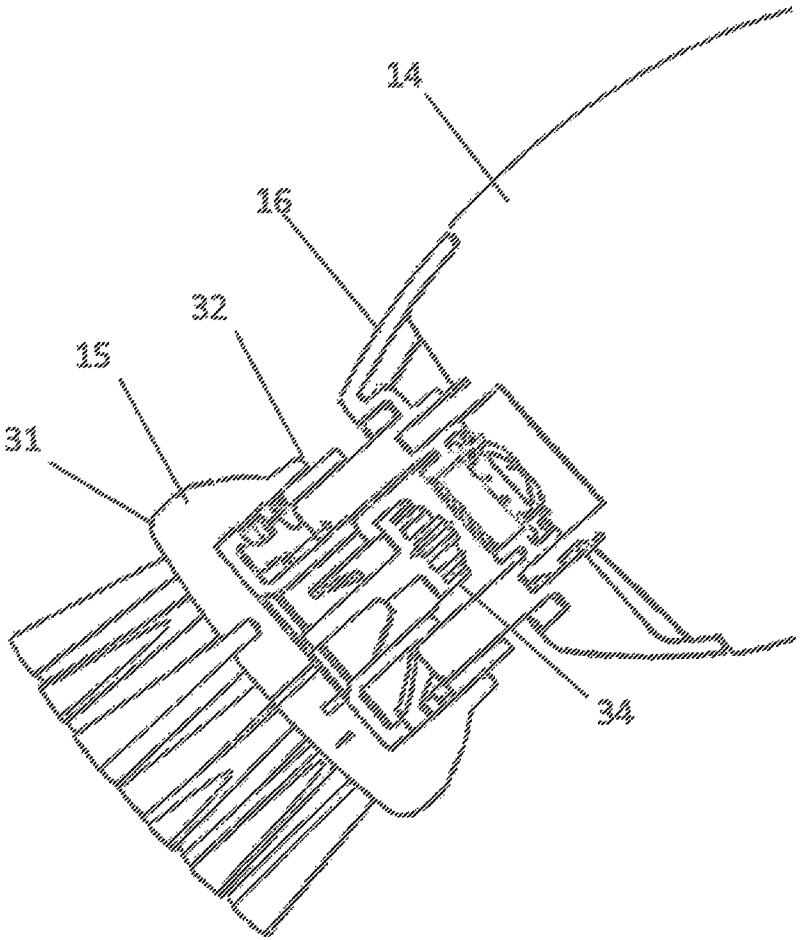

FIGS. 10-12 show the brush valve adjusted from an open position to a closed position.

DETAILED DESCRIPTION OF THE INVENTION

Figure 1:
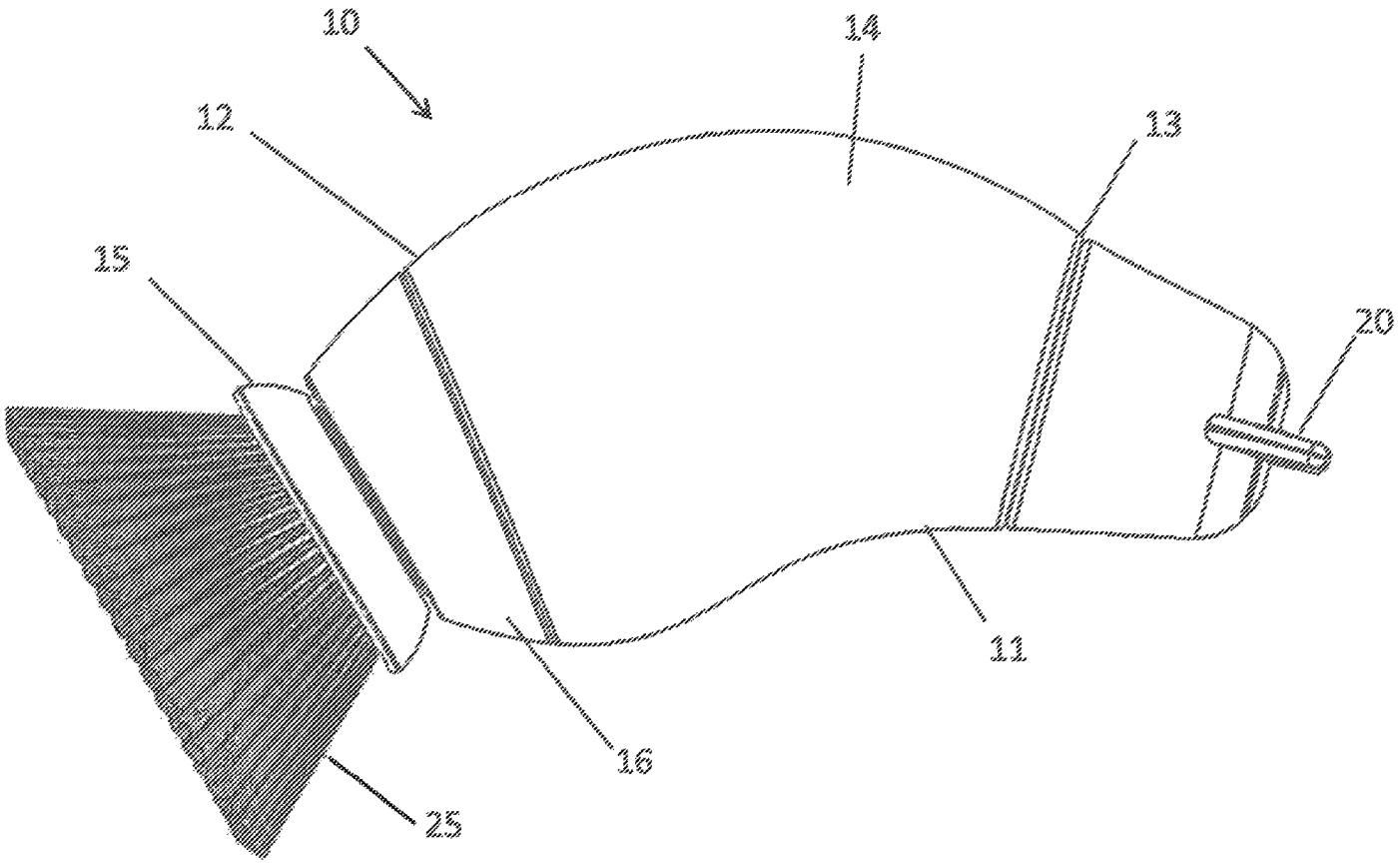
FIG. 1 shows a perspective view of a preferred embodiment of the invention.

The handheld brush of the current invention is shown in FIG. 1, referenced generally as 10. The brush 10 is suitable for cleaning footwear and comprises a body 11 which has a first end 12 and a second end 13. The body 11 also comprises an interior which comprises a cavity 14 for storing a fluid such as water or a cleaning fluid. The first end 12 of the brush 10 comprises a brush head 15. The brush head 15 is mounted on a brush base portion 16.

In the preferred embodiment shown in FIG. 1, the second end 13 of the body 11 comprises a scraping tool 20. The scraping tool 20 facilitates the removal of excess dirt from an item to be cleaned. Preferably, in use, the scraping tool 20 is used prior to cleaning an item with the brush of the first end 12.

Figure 4:
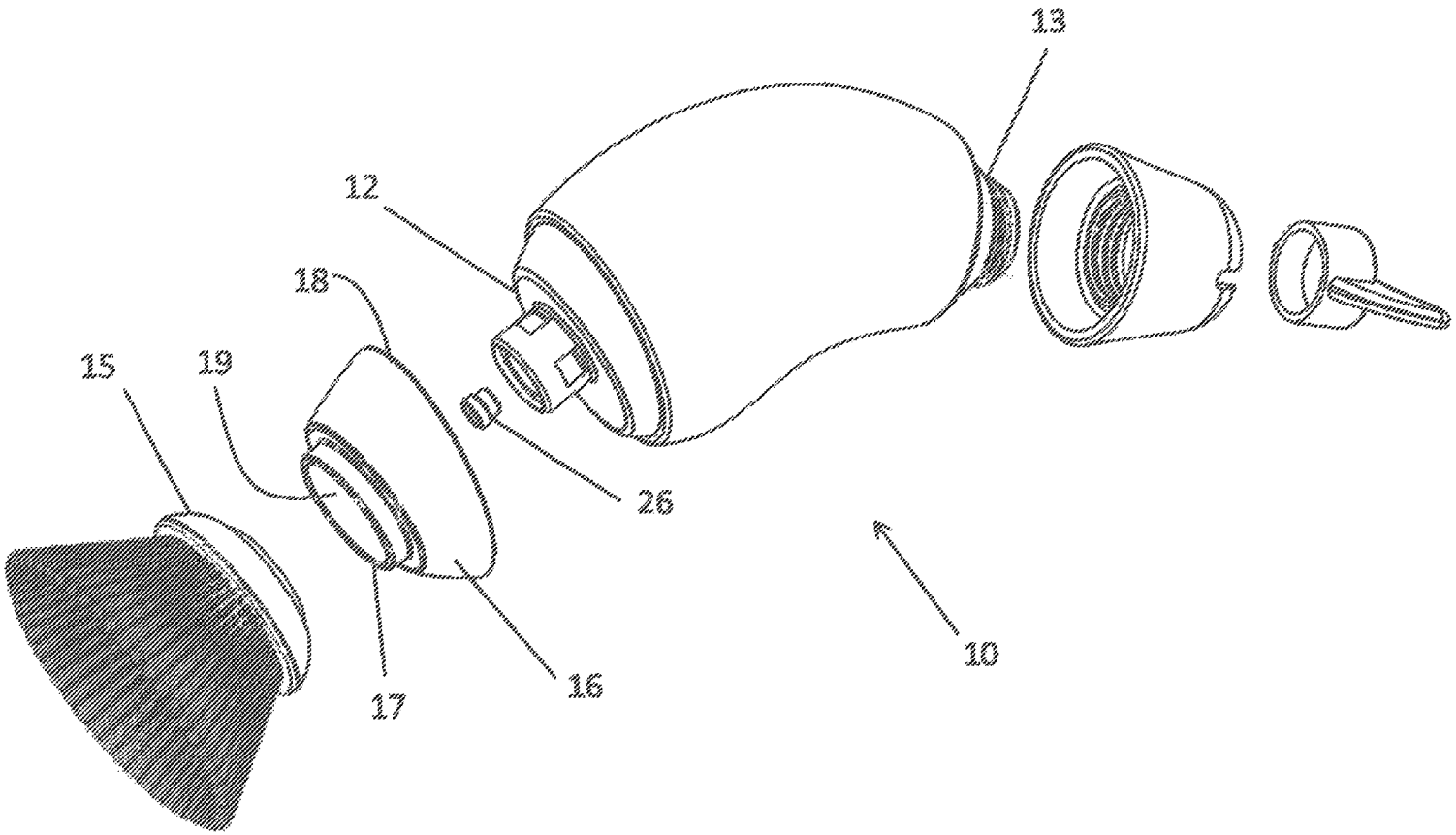
FIG. 4 shows an exploded view of a preferred embodiment of the invention.

In this preferred embodiment, the brush base portion 16 has a first face 17, a second face 18 and a passage 19 (see FIG. 4). The passage 19 runs through the brush base portion 16 and is open at both ends. A flow path therefore exists between the cavity 14 of the body 11 and the passage 19 of the brush base portion 16 such that, in use, fluid stored in the cavity can flow along the flow path in order to be expelled from the aperture of the brush base portion 16.

Figure 2:
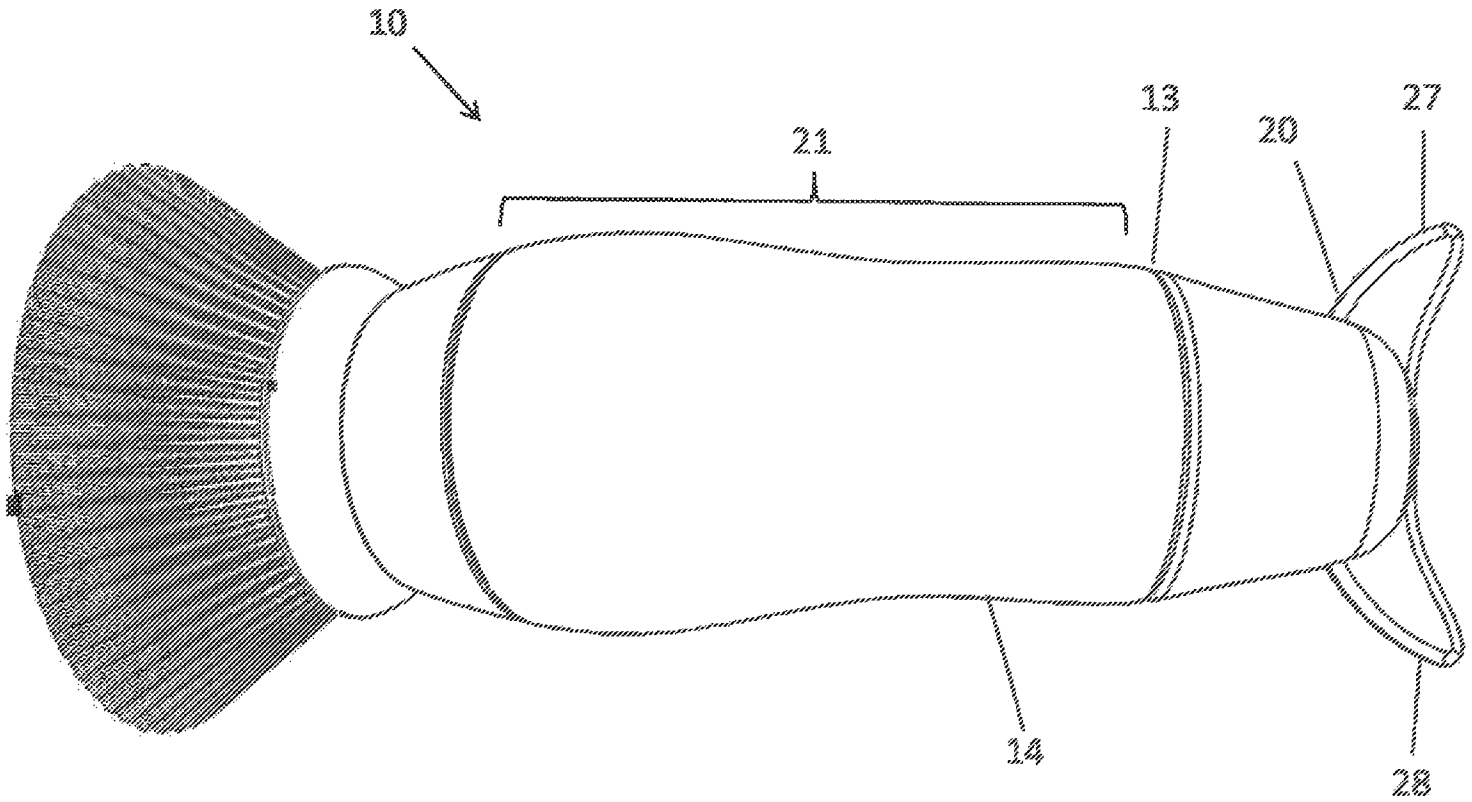
FIG. 2 shows a perspective view from above of the embodiment of FIG. 1.

Shown in FIG. 2, the body 11 of the brush 10 comprises mid-portion 21 which is resiliently deformable in order for a user to squeeze the mid-portion 21 to control the expulsion of fluid from the brush 10. The mid-portion 21 is tapered towards the second end 13 of the brush 10 in order to provide a user with an intuitive holding position. The tapered configuration allows a user with small hands, such as a child, to grip the brush at the tapered end with a smaller diameter, whilst a user with larger hands i.e. an adult, can grip the brush at the larger diameter end. The larger surface area of the first end 12 also ensures that sufficient fluid exits the cavity 14 and therefore coats the bristles of the brush 10 effectively.

Preferably, the scraping tool 20 comprises at least one projecting member which projects from a surface of said second end 13. The at least one projecting member allows a user to effectively scrape excess mud or similar from an item of footwear whilst minimising risk of damage to the brush 10 or to the item of footwear.

Preferably, the at least one projecting lug is arranged such that it projects in a direction substantially perpendicular to the lengthwise extension of the brush 10. This shape minimises the risk of mud transferring from a previously used end 12, 13 of the brush 10 to another item of clothing or to the skin of the user whilst the brush 10 is still in use.

Also shown in FIG. 2, the scraping tool 20 comprises a pair of lugs 27 and 28 which are coaxially arranged around and attached to the second end 13 of the brush 10. Preferably, the lugs 27 and 28 are sized and shaped to be able to fit within the channels located on the bottom of a shoe in order to effectively scrape excess dirt from these channels.

Additionally, the first 12 and second 13 ends of the body 11 are at substantially opposite ends of the brush 10. However, in an alternative embodiment, it is envisaged that the first and second ends are not at opposite ends of the brush. The brush may be substantially L-shaped and the first end 12 is therefore substantially perpendicular to the second end 13.

Figure 3:
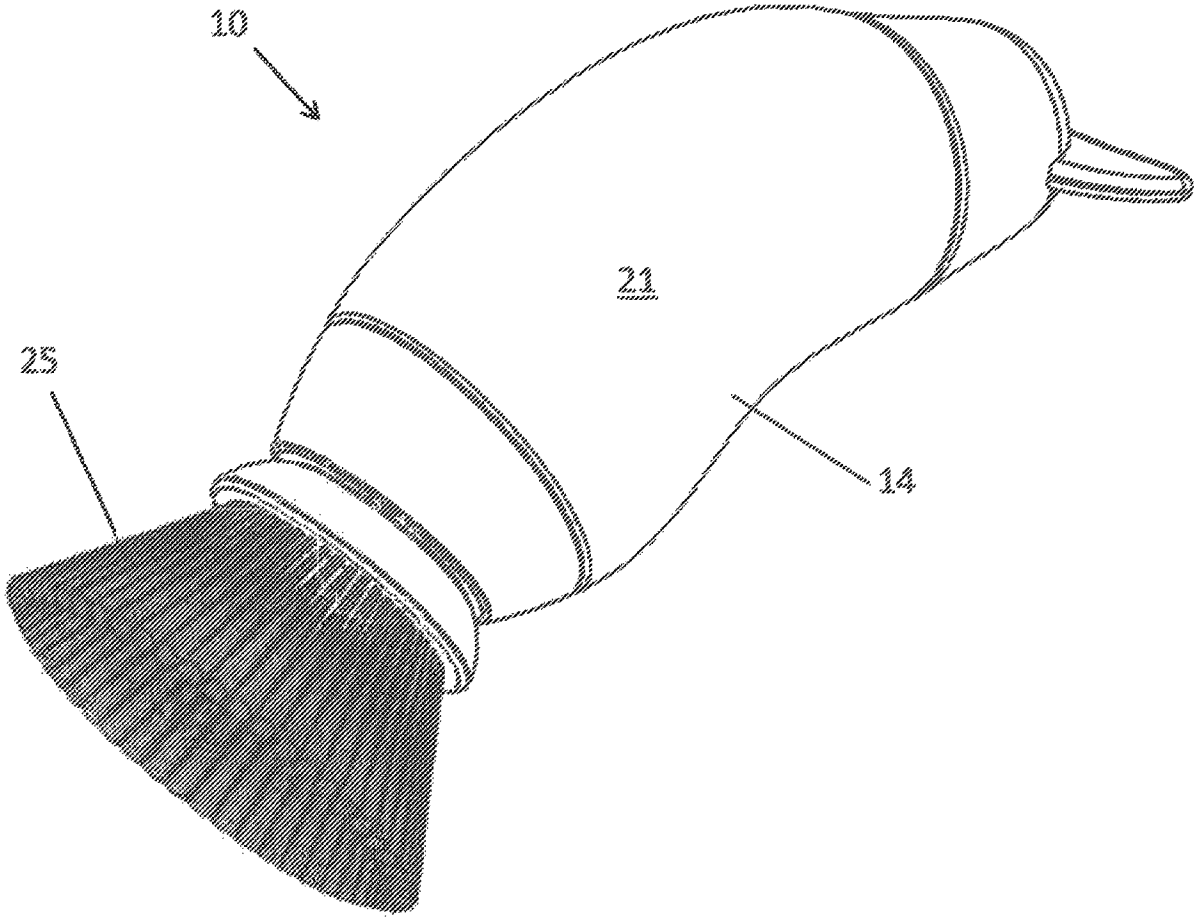
FIG. 3 shows another perspective view of a preferred embodiment of the invention.

Preferably, the brush further comprises a plurality of bristles 25 which are arranged as a cluster on the brush base portion 16 of the brush 10 (see FIGS. 3, 9*a* and 9*b*). In this preferred embodiment, the bristles 25 are arranged such that the bristles on the periphery of the cluster are greater in length than those closer to the middle of the cluster. This provides a bristle configuration which effectively covers the contour of an item to be cleaned. FIG. 9*a* shows a preferred embodiment where the bristles 25 are arranged concentrically around the bristle holding surface 22, with apertures positioned towards the centre of the bristle holding surface 22. In use, the fluid exits the apertures and coats each of the bristles 25. FIG. 9*b* shows an alternative embodiment where additional bristles 25 are positioned towards the centre of the bristle holding surface 22. In either embodiment, the apertures of the bristle holding surface 22 can be positioned between each of the bristle 25 clusters or can be positioned at the point of contact of each of the bristle 25 clusters. The arrangement of apertures is preferably substantially concentric with the shape of the bristle holding surface 22.

Preferably, the resiliently deformable mid-portion 21 comprises a curved tube in order to maximise the efficiency with which fluid is expelled from the aperture when the mid-position is squeezed. Even more preferably, the curved mid portion comprises a concavity and a grip portion to further provide an intuitive handling position for a user whereby expulsion of fluid from the brush can be effectively controlled. Preferably the grip portion is located within the concavity of the curve of the mid-portion 21.

Figure 8:
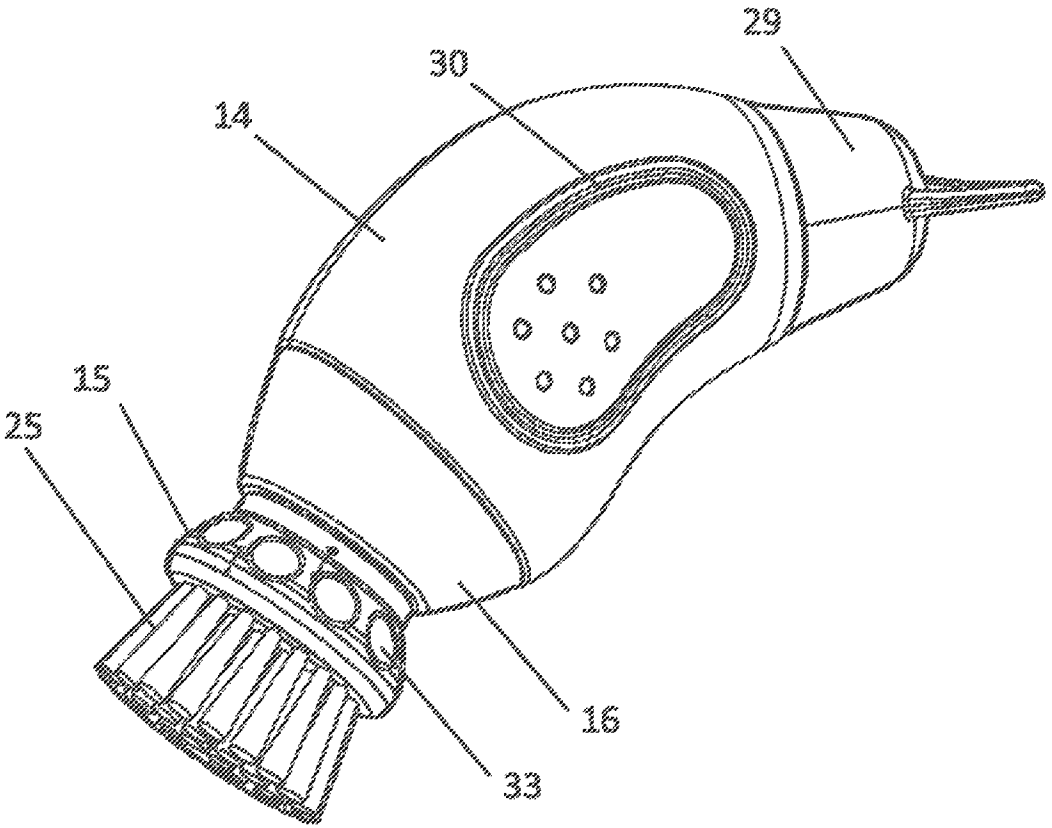
FIG. 8 shows another perspective view of a preferred embodiment of the invention.

Preferably, the grip portion of the mid portion 21 incorporates a number of depressions or embossments 30 as shown in FIG. 8. The depressions or embossments 30 provide increased grip to a user which is particularly advantages when the brush 1 becomes wet or if a user is using the brush 10 whilst wearing gloves.

In the preferred embodiment, shown in FIG. 4, the brush 10 further comprises a valve 26 located adjacent the first end 12. The valve 26 may be moved from a first position, where the flow path is open, to a second position where the flow path is closed (and vice versa) in order to regulate and control the flow of fluid stored in the cavity 14 along the flow path.

In a further preferred embodiment, the valve 26 comprises a non-return valve such that the valve is caused to open when the resiliently deformable mid-portion 21 of the brush 10 is squeezed and closes when the squeezing force ceases. In this preferred embodiment the non-return valve 26 consists of a cross-slit silicone membrane which is resiliently deformable upon squeezing of the mid portion by a user. This removes the requirement for a manually operated valve which therefore further minimises the risk of spillage when the brush 10 is not in use.

Further shown in FIG. 4, each of the components of the brush 10, such as the valve 26 and scraper 20, are detachable from the first and second ends 12 and 13. This allows for different components, such as different size or strength bristles, or a different sized scraper 20, to be selectively and removably attached to the body 11 of the brush 10. This is particularly advantageous where a component, such as the scraper 20 of the brush 10, is worn down and requires a replacement to be fitted. This configuration also allows for effective cleaning of the brush components.

Figure 5:
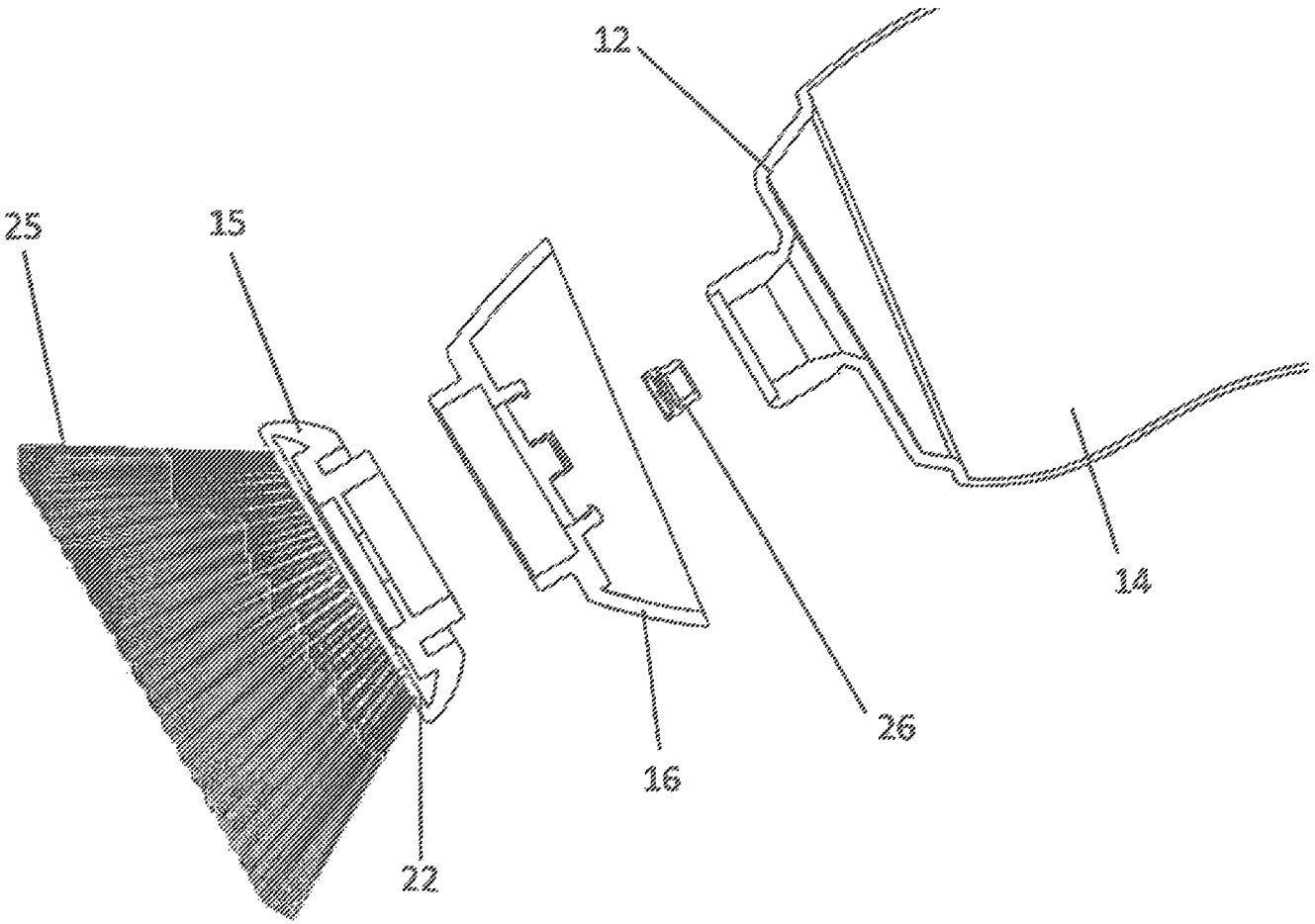
FIG. 5 shows an exploded cross sectional view of the first end of a preferred embodiment.

Shown in the cross-sectional view of FIG. 5, the brush 10 further comprises a bristle holding surface 22 with an aperture to further allow fluid to flow from the cavity 14 through the bristle holding surface 22. The flow path therefore exists between the cavity 14 of the body 11 and the bristles 25 of the brush 10, flowing through each component including the first end 12 of the body 11; the valve 26; the brush base portion 16; the brush head 15; and the bristle holding surface 22 such that fluid can be squeezed from the cavity to coat the bristles.

In a further preferred embodiment, the brush holding surface 22 comprises a plurality of apertures so that fluid contained within the cavity 14 of the body 11 can be spread evenly across the brush bristles 25. The plurality of apertures ensures that each of the bristles of the brush 25 is adequately coated with the fluid prior to cleaning.

Figure 6:
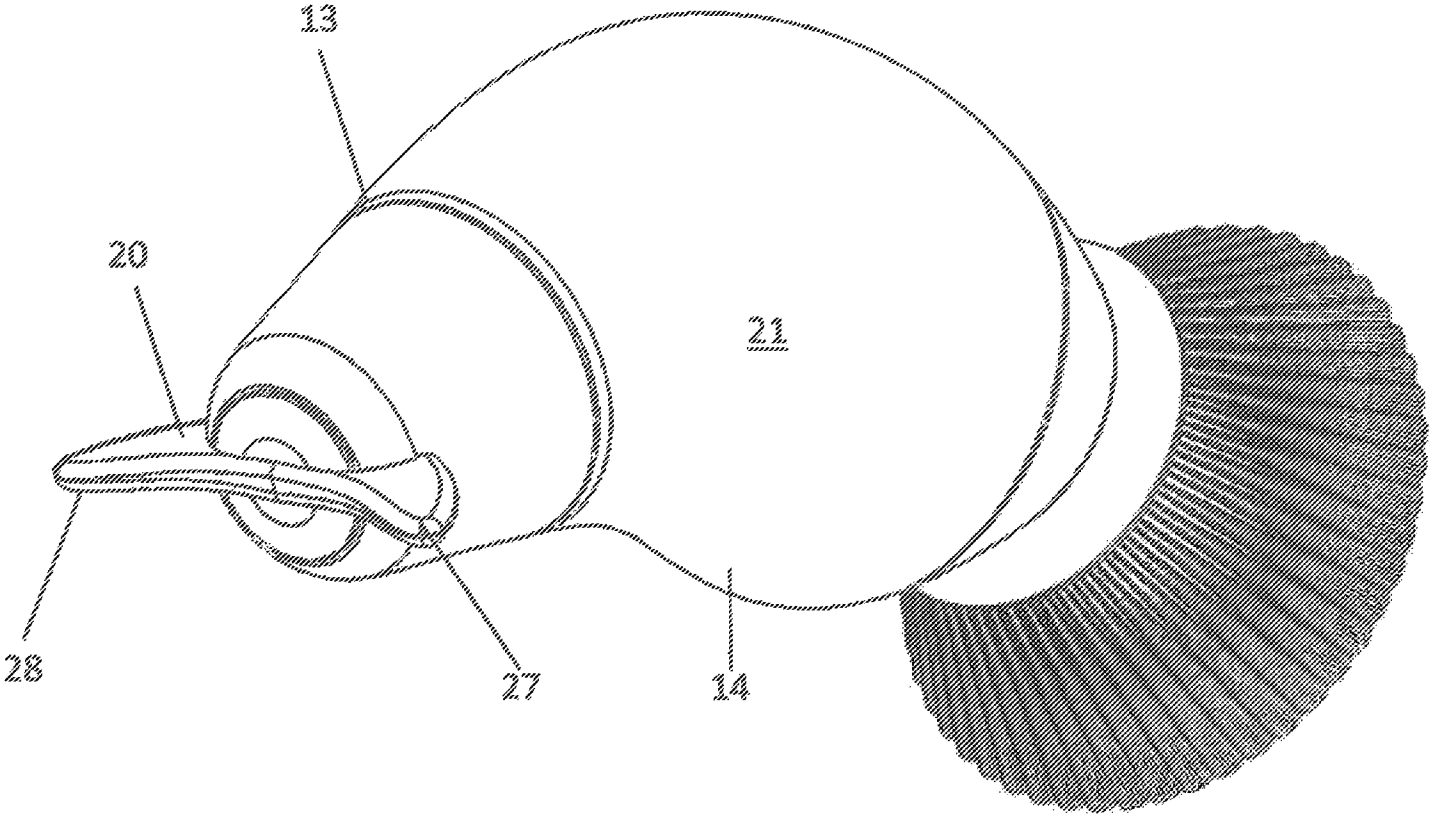
FIG. 6 shows another perspective view of a preferred embodiment of the invention.

FIG. 6 shows a perspective view of the brush 10 from the second end 13. FIG. 6 again shows how, in the preferred embodiment, the body comprises a portion of resiliently deformable material 21 so that, in use, squeezing of this portion by a user causes the cavity 14 to deform, thereby forcing fluid along the flow path such that it may be expelled from the aperture of the brush base portion 16. It is preferable therefore that the body consist of plastics material such as polypropylene so that it may be repeatedly deformed with minimal damage or change in configuration of the brush.

Figure 7:
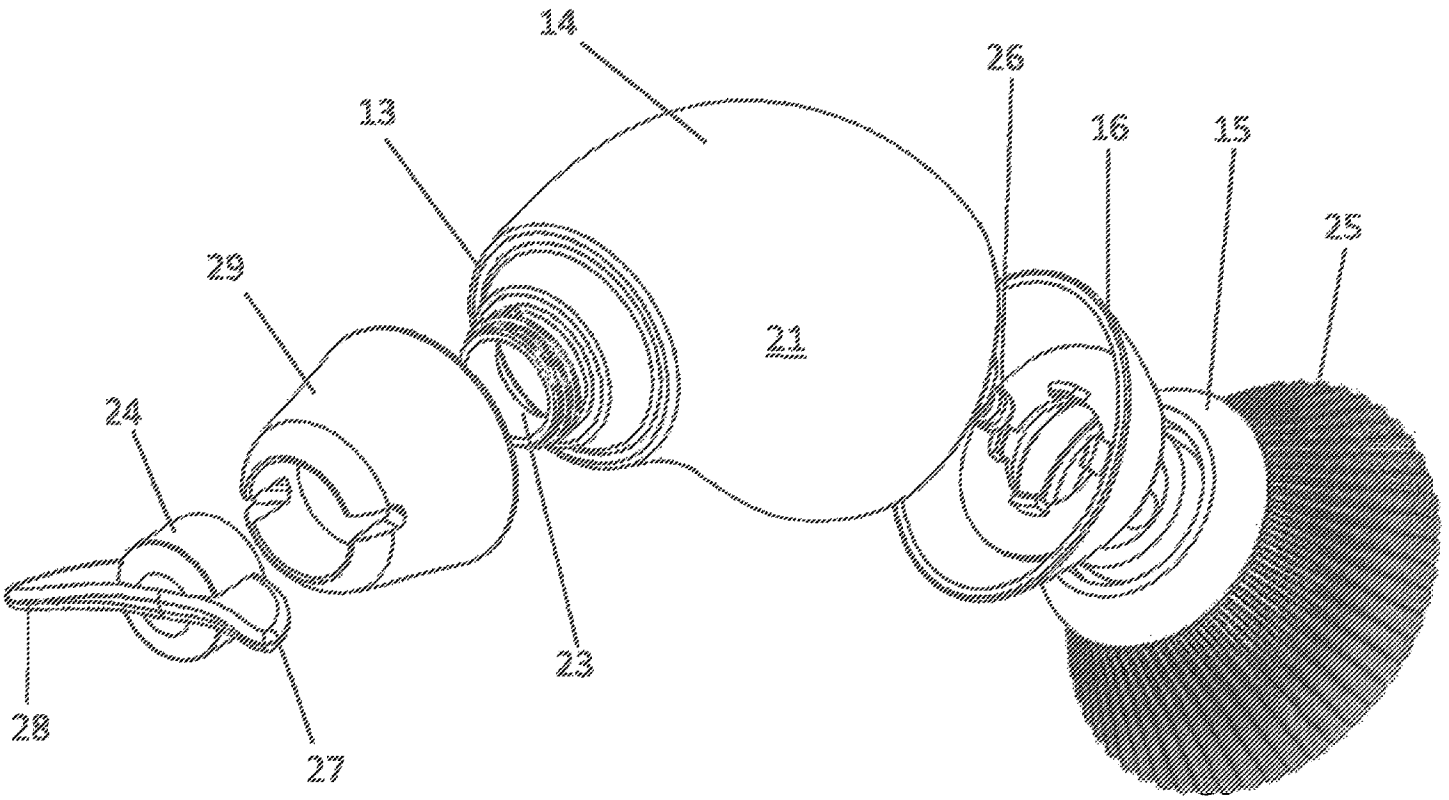
FIG. 7 shows another exploded view of a preferred embodiment of the invention.

It is also preferably that the body consists of a single piece of plastics material which varies in thickness along its length. Preferably, the body is thicker at the first and second ends in order to facilitate a snap fit with the components to be attached to the ends (see FIG. 7). The thickness of the body is reduced in the mid-portion in order to facilitate the deformation of the body to squeeze the fluid contents towards the first end and out of the first aperture.

In the preferred embodiment, the brush 10 further comprises a secondary aperture 23 which is located at the second end 13 of the brush 10. In this embodiment a portion 29 of the second end 13 is removable and a closure 24 is present for the secondary aperture 23. The secondary aperture 23 allows fluid to be straightforwardly decanted into the cavity 14 to refill the brush 10. The aperture 23 also allows fluid to be efficiently evacuated from the brush 10 if required, rather than having to force all of the fluid out of the first end 12. The closure 24 ensures that fluid does not escape from the cavity via the secondary aperture, particularly during use and further ensures that the pressure applied by the user effectively transfers the contained fluid towards the first end 12 of the brush 10.

In the preferred embodiment, as shown in FIGS. 10 to 12, the brush valve 26 is adjusted from an open position to a closed position and vice versa upon the rotation of the brush head 15 and the brush base portion 16. In the closed position the brush head 15 is positioned adjacent the brush base portion 16, and in the open position the brush head 15 is extended away from the brush base portion 16. In the closed position, the valve 26 is closed and in the open position the valve 26 is open to allow fluid contained in the mid-portion 14 to exit the apertures of the bristle holding surface 22. This is particularly advantageous because it provides a mechanism which effectively contains the contained fluid when the brush 10 is not in use. It also provides additional length to the brush 10 when in use so that a user can achieve further reach.

In the preferred embodiment, the brush 10 further comprises releasable locking means for locking the valve 26 in at least one of the open position and the closed position. The locking means allow the brush head 15 to be locked into its open and closed configurations. This reduces the possibility of the brush head 15 unduly retracting whilst the brush 10 is in use.

In the preferred configuration, the releasable locking means comprises a detent and corresponding groove at each extremity of the relatively rotational movement, such that the detent can be clinched in and out of its groove by the rotation of the brush head 15 and the brush base portion 16. In one embodiment, the brush head 15 comprises a groove and the brush base portion 16 comprises a detent, whereby the groove of the brush head 15 and the detent of the brush base portion 16 are adapted to interact with each other in order for the brush head 15 to be reversibly extended away from the brush base portion 16 when a twisting motion is applied to the brush head 15. When twisted, the brush head 15 moves from the closed position to the open position. This allows the brush head 15 to be controllably extended away from the brush base portion 16. In the closed position, fluid is blocked from exiting the cavity 14 of the body 11 by a plug 34, and when in the open position, fluid is allowed to exit through passage 19 towards the apertures of the bristle holding surface 22.

In an alternative embodiment, the brush head 15 incorporates a protrusion which runs along the inside surface of the brush head 15 in a screw-like manner, and the brush base portion 16 incorporates a corresponding recess. A similar twisting motion is still applied to the brush head 15 in order to reversibly extend it away from the remainder of the brush 10.

In further alternative embodiments, the groove and detent of the brush head 15 and brush base portion 16 are located on the outer surfaces of the brush head 15 and brush base portion 16.

In the preferred embodiment, the brush head 15 incorporates a number of indentations and/or projections 33 (see FIGS. 8 and 11), which are located between the first face 31 and second face 32 of the brush head 15. The indentations and/or projections 33 provide improved grip to the brush head 15, so that the twisting motion required to extend the brush head 15 away from the brush base portion 16 can be efficiently applied to the brush head 15. The improved grip is particularly advantageous when the brush 10 is wet or when a user is wearing clothing which reduces the friction against the brush 10, such as wool gloves, which are often worn in the same conditions which result in footwear becoming muddy.

In use, a portion 29 of the second end 13 of the brush 10 is removed and fluid is decanted into the cavity 14 of the brush via the secondary aperture 23, once its closure 24 has been removed. Once the closure 24 and second end portion 29 have been replaced, the fluid is stored in the cavity 14 until use of the brush 10 is required. During this time the valve 26 is in its closed position to prevent any unwanted spillage of the contained fluid. Where a non-return valve is employed, the valve remains in its closed position automatically until pressure is applied to the mid-portion 21 of the brush 10.

When an item, such as an item of footwear, requires cleaning the valve (where a manual valve is employed) is moved to its opened position so that fluid may pass from the cavity 14 through the flow path and out the plurality of apertures of the bristle holding surface 22. Where a non-return valve is present, the valve opens when pressure is applied by the user to the resiliently deformable portion 21 of the body 11.

Prior to this, the scraper 20 of the second end 13 may be employed to remove excess dirt from the footwear. In an alternative embodiment the scraper 20 is removable from the rest of the brush 10 in order for a user to reach tricky areas of the footwear. Following this the user can intuitively slot the scraper back into the closure 24.

As the mid-portion 21 of the body 11 is squeezed, fluid is forced from the cavity 14 towards the bristle holding surface 22. The fluid subsequently exits the apertures of the is bristle holding surface and coats the bristles 25. The plurality of apertures ensures that each of the bristles is adequately covered with fluid prior to cleaning.

During use, a user can alter the amount of pressure applied to the mid-portion 21 in order to regulate the amount of fluid which exits the first end 12 of the brush. The resiliently deformable configuration of the mid-portion allows this regulation to occur whilst the brush is being used without any interruption.

When use of the brush is finished, the user can release all pressure on the mid-portion 21 in order to cease the flow of fluid from the cavity. The closure 24 and portion 29 can be subsequently removed from the second end 13 in order to evacuate remaining fluid from the cavity 14. Alternatively, the fluid can be stored in the cavity 14 until the brush is next required.

In an alternative embodiment, a sponge (not shown) is attached to the brush head 15 rather than a cluster of bristles. Operation of the brush is carried out in the normal way in this embodiment, with the fluid flowing towards the first end and saturating the sponge prior to and during use. In further alternative embodiments, different ends can be selectively attached to the first end 12 of the brush 10 in order to provide different cleaning effects.

In another alternative embodiment, the brush only comprises a single aperture at the first end. In this embodiment, filling of the cavity with fluid can occur once the base portion 16 and brush head 15 have been removed. In this embodiment, the scraper 20 is removably attached to the second end 13 of the brush 10.

The invention claimed is:

1. A single handheld brush, the brush comprising a body, the body being elongate and comprising first and second ends and an interior, the interior comprising a cavity, wherein, in use, fluid may be stored, wherein the first end comprises a brush head that is mounted on a brush base portion, the brush base portion having a first face and a second face and a passage having a first end and a second end, the passage running through the brush base portion and being open at both the first end and the second end and wherein the second end of said body comprises a scraping tool;

a flow path running from the cavity, to an aperture in the brush base portion, such that fluid in the cavity may flow along the flow path and be expelled from the aperture; and a valve closure located adjacent the first end, wherein the valve may be moved from an open position wherein the flow path is open, to a closed position wherein the flow path is shut and vice versa, to regulate the flow of fluid through the aperture; and a mid-portion situated between the first and second ends, wherein the mid portion comprises a curved tube;

wherein the body further comprises at least portion of resiliently deformable material such that in use, squeezing the portion of resiliently deformable material causes the cavity to deform, thereby forcing fluid contained within the cavity along the flow path to be expelled from the aperture.

2. A brush according to claim 1, wherein the valve comprises a dispensing closure, such that the valve is caused to open when the resiliently deformable portion is squeezed and fluid is forced through it, and closes when the squeezing force ceases.

3. A brush according to claim 1, wherein the brush comprises a bristle holding surface and wherein the aperture is located on the bristle holding surface of the brush.

4. A brush according to claim 1, wherein the first end and the second end are substantially at opposite ends of the brush.

5. A brush according to claim 1, wherein the resiliently deformable portion comprises said mid-section of the brush.

6. A brush according to claim 1, further comprising a secondary aperture located adjacent the second end, and wherein the second end is removable and comprises a closure, in use, for the secondary aperture.

7. A brush according to claim 6, wherein each of the ends and the valve is detachable from the other components of the brush.

8. A brush according to claim 1, wherein the scraping tool comprises at least one projecting member which projects from a surface of said second end.

9. A brush according to claim 8, wherein the at least one projecting member is arranged such that it projects in a direction substantially perpendicular to the lengthwise extension of the brush.

10. A brush according to claim 1, wherein the scraper comprises a pair of lugs, coaxially arranged around and attached to the second end.

11. A brush according to claim 1, wherein the mid portion of the brush is tapered towards the second end.

12. A brush according to claim 1, wherein the curved mid portion comprises a concavity and a grip portion, with said grip portion located within the concavity of the curve of the mid portion.

13. A brush according to claim 12, wherein said grip portion of the curved mid portion incorporates a number of depressions or embossments.

14. A brush according to claim 1, wherein said brush further comprises releasable locking means for locking the valve in at least one of the open position and the closed position.

15. A brush according to claim 14, wherein the brush valve is adjusted from an open position to a closed position and vice versa upon the rotation of the brush head relative to the brush base portion.

16. A brush according to claim 15, wherein the releasable locking means comprises a detent and corresponding groove at each extremity of the relatively rotational movement, such that the detent can be clinched in and out of its groove by the rotation of the brush head and the brush base portion.

17. A brush according to claim 14, wherein said brush further comprises a plug which contacts said valve when said brush head is in the closed position.

18. A brush according to claim 1, wherein said brush head incorporates a number of indentations or projections.

* * * * *